US010338493B2

(12) United States Patent
Imase

(10) Patent No.: US 10,338,493 B2
(45) **Date of Patent: *Jul. 2, 2019**

(54) DEVELOPING ROLLER, AND METHOD OF PRODUCING THE SAME

(71) Applicant: SUMITOMO RUBBER INDUSTRIES, LTD., Kobe-Shi, Hyogo (JP)

(72) Inventor: Yuta Imase, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/372,008

(22) Filed: Dec. 7, 2016

(65) Prior Publication Data

US 2017/0176885 A1 Jun. 22, 2017

(30) Foreign Application Priority Data

Dec. 21, 2015 (JP) ..... 2015-248614

(51) Int. Cl.
*G03G 15/08* (2006.01)

(52) U.S. Cl.
CPC ..... *G03G 15/0808* (2013.01); *G03G 15/0818* (2013.01)

(58) Field of Classification Search
CPC ..... G03G 15/0808; G03G 15/0818; G03G 2215/0855; G03G 2215/0861; G03G 2215/0863
See application file for complete search history.

(56) References Cited

U.S. PATENT DOCUMENTS 9,939,752 B2 * 4/2018 Imase ..... G03G 15/0233 399/176
2002/0086125 A1 * 7/2002 Kakii ..... G03G 15/0233 428/36.91

(Continued)

FOREIGN PATENT DOCUMENTS

JP 2003-156902 A 5/2003
JP 3580340 B2 10/2004

(Continued)

*Primary Examiner* — Thomas S Giampaolo, II
(74) *Attorney, Agent, or Firm* — Birch, Stewart, Kolasch & Birch, LLP

(57) ABSTRACT

A developing roller (1) is provided, which includes a tubular porous inner layer (2) of a foamed product of a semiconductive rubber composition containing an ethylene propylene rubber and a paraffin oil, and an outer layer (4) of a seamless tube of a semiconductive thermoplastic polyamide elastomer provided on an outer peripheral surface (3) of the inner layer (2), and has an overall Asker-C hardness of not less than 30 degrees and not greater than 60 degrees. A production method is also provided, which includes the steps of: preparing a tube having a thickness T of 100 to 400 μm and having an inner diameter $D_2$ for an outer layer; preparing a tubular inner layer having an outer diameter $D_1$; and press-inserting the inner layer into the tube; wherein an interference represented by a difference $D_1$- $D_2$ between the outer diameter $D_1$ of the inner layer and the inner diameter $D_2$ of the tube is 100 to 400 μm.

4 Claims, 2 Drawing Sheets

(56) References Cited

U.S. PATENT DOCUMENTS

| | | | | |
|---|---|---|---|---|
| 2008/0232862 | A1* | 9/2008 | Fujishima | G03G 15/0818 399/285 |
| 2015/0132031 | A1* | 5/2015 | Hagiwara | G03G 15/0808 399/286 |

FOREIGN PATENT DOCUMENTS

| | | | |
|---|---|---|---|
| JP | 2005-134503 | A | 5/2005 |
| JP | 2014-170158 | A | 9/2014 |

* cited by examiner

DEVELOPING ROLLER, AND METHOD OF PRODUCING THE SAME

TECHNICAL FIELD

The present invention relates to a developing roller to be incorporated in an electrophotographic image forming apparatus, and to a method of producing the developing roller.

BACKGROUND ART

In an electrophotographic image forming apparatus such as a laser printer, an electrostatic copying machine, a plain paper facsimile machine or a printer-copier-facsimile multifunction machine, a developing roller is used for developing an electrostatic latent image formed on a surface of a photoreceptor body into a toner image In general, the developing roller is produced by blending an electron conductive agent and/or an ion conductive agent with a rubber to prepare a semiconductive rubber composition imparted with a semiconductivity, forming the semiconductive rubber composition into a tubular body, and crosslinking the tubular body.

In recent years, the developing roller is required to have a reduced diameter for size reduction of the image forming apparatus, and the image forming apparatus is required to operate at a higher speed, so that the rotation speed of the developing roller tends to be increased.

Further, in recent years, a layer forming blade kept in abutment against the developing roller in a developing section of the image forming apparatus tends to apply an increased abutment force to an outer peripheral surface of the developing roller in order to improve the toner chargeability.

Therefore, parts of the outer peripheral surface of the developing roller against which opposite edge portions of the layer forming blade are kept in abutment are problematically liable to be worn or damaged in a short period of time, and the toner is often liable to leak laterally from the opposite edge portions of the layer forming blade.

Particularly, where the developing roller is allowed to have a porous structure to be imparted with an improved flexibility by foaming and crosslinking the semiconductive rubber composition with the use of a foaming agent, the problem of the lateral toner leakage tends to occur in a shorter period of time.

To cope with this, it is proposed to allow the developing roller to have a porous structure to be imparted with proper flexibility, and to form a coating layer on the outer peripheral surface of the developing roller by applying a coating agent containing a urethane resin, a phenol resin, a fluororesin, a silicone resin or the like to at least the parts of the outer peripheral surface of the developing roller to be kept in abutment against the opposite edge portions of the layer forming blade and drying the coating agent and, where the coating agent contains the urethane resin or the phenol resin, curing the resin (Patent Document 1 and the like).

However, the coating layer of the urethane resin or the phenol resin has a poorer slidability though being excellent in wear resistance. Therefore, the developing roller is liable to have an increased rotation torque, making it difficult to properly perform the image formation. On the other hand, the coating layer of the fluororesin or the silicone resin is excellent in slidability but has an insufficient wear resistance and, therefore, is liable to be worn to lose its effect in a shorter period of time.

For preparation of the coating agent, an organic solvent is required. The use of the organic solvent may exert a great load on the environment, and go against a recent trend toward reduction of VOC (volatile organic compounds).

It is contemplated to form a tubular porous inner layer of a foamed product of a semiconductive rubber composition and cover a generally entire outer peripheral surface of the inner layer with an outer layer of a seamless semiconductive resin tube (Patent Documents 2 and 3, and the like).

The tube for the outer layer is formed by extruding a resin. A resin excellent in strength, wear resistance and the like is selected for use as the resin for the tube, because there is no need to consider the solubility of the resin in an organic solvent. Therefore, the outer layer thus formed has a higher strength and an excellent wear resistance.

Further, the outer layer formed from the aforementioned resin through the aforementioned process has a smooth surface having an excellent slidability to suppress the increase in the rotation torque of the developing roller, making it possible to properly form an image.

CITATION LIST

Patent Document

[PATENT DOCUMENT 1] JP3580340B
[PATENT DOCUMENT 2] JP2005-134503A
[PATENT DOCUMENT 3] JP2014-170158A

SUMMARY OF THE INVENTION

Problem to be Solved by the Invention

The conventional developing roller having a double layer structure including the inner layer and the outer layer is configured such that the outer periphery of the porous and intrinsically flexible inner layer is tightened by the outer layer. Therefore, the developing roller is liable to have an overall flexibility that is lower than the flexibility of a conventional developing roller including an inner layer alone. Correspondingly, the developing roller is liable to deteriorate the toner, so that a formed image is liable to suffer from density unevenness.

It is an object of the present invention to provide a developing roller which includes a highly flexible porous inner layer and an outer layer of a tube excellent in slidability and wear resistance and is entirely flexible enough to properly suppress the deterioration of the toner, and to provide a method of producing the developing roller.

Solution to Problem

According to an inventive aspect, there is provided a developing roller, which includes a tubular porous inner layer of a foamed product of a semiconductive rubber composition containing an ethylene propylene rubber and a paraffin oil, and an outer layer of a seamless tube of a semiconductive thermoplastic polyamide elastomer provided on an outer periphery of the inner layer, and has an overall Asker-C hardness of not less than 30 degrees and not greater than 60 degrees.

According to another inventive aspect, there is provided a method of producing the inventive developing roller, which includes the step of press-inserting a tubular inner layer into a tube serving as a material for an outer layer, the tube having a wall thickness T of not less than 100 μm and not greater than 400 μm, the inner layer having an outer diameter $D_1$ that is greater than an inner diameter $D_2$ of the tube; wherein an interference represented by a difference $D_1$-$D_2$ between the outer diameter $D_1$ of the inner layer and the inner diameter $D_2$ of the tube is not less than 100 μm and not greater than 400 μm.

Effects of the Invention

According to the present invention, the developing roller is provided, which includes a highly flexible porous inner layer and an outer layer of a tube excellent in slidability and wear resistance and is entirely flexible enough to properly suppress the deterioration of the toner. The method of producing the developing roller is also provided.

EMBODIMENTS OF THE INVENTION

Figure 1A:
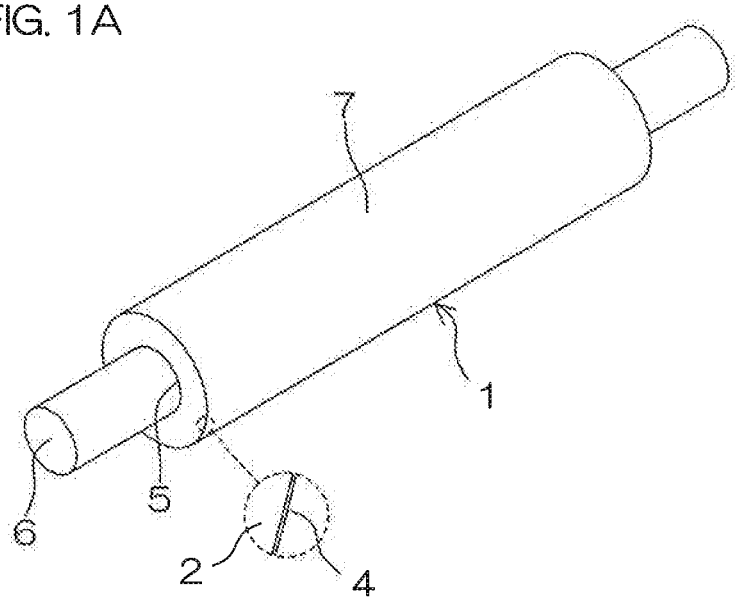
FIG. 1A is a perspective view showing a developing roller according to an embodiment of the present invention.
Figure 1B:
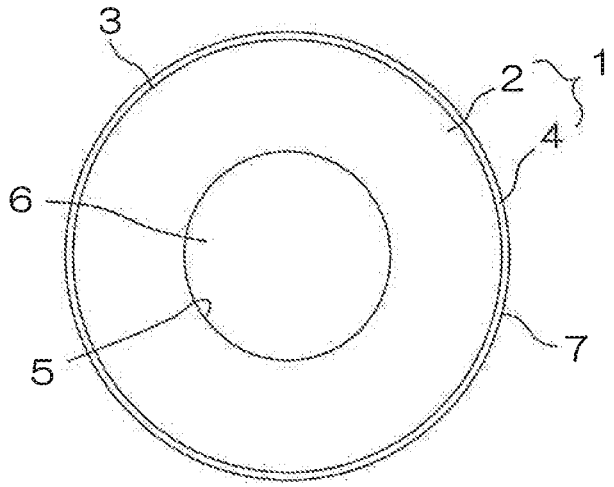
FIG. 1B is an end view of the developing roller.

FIG. 1A is a perspective view showing a developing roller according to an embodiment of the present invention, and FIG. 1B is an end view of the developing roller.

Referring to FIGS. 1A and 1B, the developing roller 1 includes a tubular porous inner layer 2 of a foamed product of a semiconductive rubber composition containing an ethylene propylene rubber and a paraffin oil, and an outer layer 4 of a seamless tube of a semiconductive thermoplastic polyamide elastomer provided on an outer peripheral surface 3 of the inner layer 2. A shaft 6 is inserted through and fixed to a center through-hole 5 of the inner layer 2.

The developing roller 1 is required to have an overall Asker-C hardness of not less than 30 degrees and not greater than 60 degrees.

The ethylene propylene rubber, which is highly affinitive and highly compatible with the paraffin oil, is selected as a rubber component of the semiconductive rubber composition for the inner layer 2 of the developing roller 1. Further, the blending of the paraffin oil reduces the melt viscosity of the semiconductive rubber composition to improve the foamability of the semiconductive rubber composition. The semiconductive rubber composition is foamed and cross-linked to provide a foam having an increased expansion ratio. Thus, the inner layer 2, which is formed of the foam, has an improved flexibility.

The outer layer 4 is formed of the tube of the thermoplastic polyamide elastomer, which is less affinitive and less compatible with the ethylene propylene rubber and the paraffin oil, to function as a barrier layer against the paraffin oil. As a result, the paraffin oil contained in the inner layer 2 is substantially prevented from bleeding on the outer peripheral surface 7 of the developing roller 1 to contaminate the photoreceptor body.

According to the present invention, the combination of the inner layer 2 and the outer layer 4 prevents the developing roller 1 from contaminating the photoreceptor body, and imparts the developing roller 1 with a flexibility satisfying the requirement for an overall Asker-C hardness of not greater than 60 degrees. Thus, the developing roller 1 advantageously suppresses the deterioration of the toner.

The overall Asker-C hardness of the developing roller 1 is limited to not greater than 60 degrees and not less than 30 degrees for the following reason.

If the overall Asker-C hardness is less than the aforementioned range, the outer layer 4 of the developing roller 1 is liable to be displaced with respect to the inner layer 2, for example, during image formation, because the outer layer 4 applies an insufficient tightening force to the inner layer 2 as will be described later.

If the overall Asker-C hardness is greater than the aforementioned range, on the other hand, the developing roller 1 is liable to have a lower flexibility as a whole to cause the deterioration of the toner and the associated density unevenness.

Where the overall Asker-C hardness of the developing roller 1 falls within the aforementioned range, in contrast, the developing roller 1 is imparted with a proper flexibility. Thus, the developing roller 1 is free from the displacement of the outer layer 4, and advantageously suppresses the deterioration of the toner, making it possible to form an image free from the density unevenness.

For further improvement of this effect, the overall Asker-C hardness of the developing roller 1 is preferably not less than 45 degrees and not greater than 50 degrees within the aforementioned range.

In the present invention, the overall Asker-C hardness of the developing roller 1 is measured at a temperature of 23±2° C. at a humidity of 55±2% by a measuring method specified in Society of Rubber Industry, Japan, Standard SRIS 0101 "Physical Testing Method for Expanded Rubber."

Since the surface of the tube 8 is too smooth on an as-is basis, the outer peripheral surface 7 of the developing roller 1 fails to transport a sufficient amount of the toner. Accordingly, the formed image is liable to have an insufficient black solid density.

Therefore, the outer peripheral surface 7 is preferably roughened, for example, by polishing or the like.

The surface roughness of the roughened outer peripheral surface 7 may be set as desired. For formation of a high-definition image, the developing roller 1 preferably has a profile curve arithmetic average roughness Ra of not greater than 1.5 μm which is specified in Japanese Industrial Standards JIS $B0601_{:2013}$ "Geometrical product specifications (GPS)—Surface texture: Profile method—Terms, definitions and surface texture parameters."

In order to sufficiently provide the effect of the roughening, the outer peripheral surface 7 preferably has an arithmetic average roughness Ra of not less than 0.5 μm.

Figure 2A:
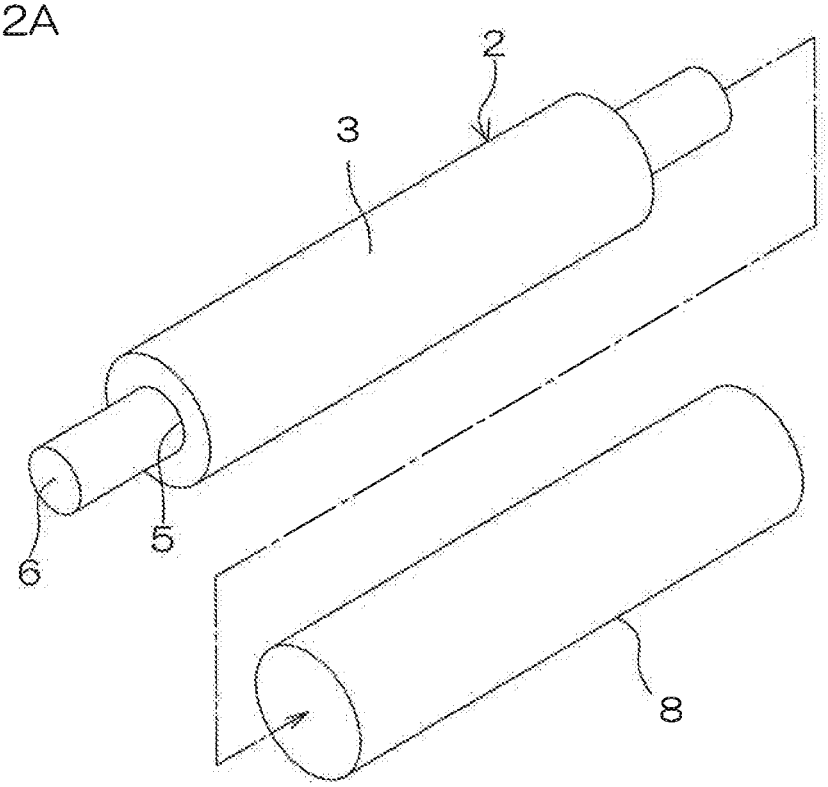
FIG. 2A is a perspective view showing a process step of a production method according to another embodiment of the present invention.
Figure 2B:
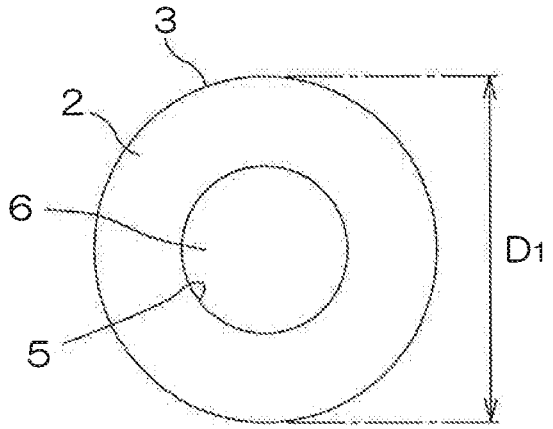
FIG. 2B is an end view of an inner layer to be used in the above process step.

FIG. 2A is a perspective view showing a process step of a production method according to another embodiment of the present invention. FIG. 2B is an end view of an inner layer to be used in the above process step, and FIG. 2C is an end view of a tube which later serves as an outer layer.

Figure 2C:
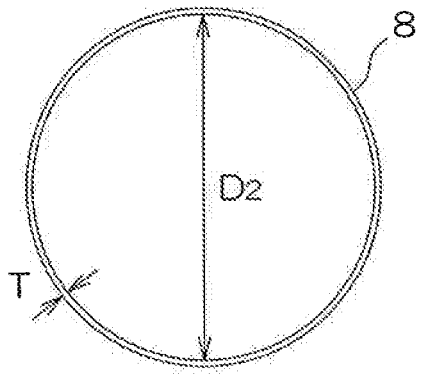
FIG. 2C is an end view of a tube which later serves as an outer layer.

In the production method, referring to FIGS. 2A to 2C, a seamless tube 8 of a semiconductive thermoplastic polyamide elastomer for an outer layer 4, and a tubular inner layer 2 having an outer diameter $D_1$ greater than the inner diameter $D_2$ of the tube 8 with a shaft 6 preliminarily inserted through and fixed to a center through-hole 5 thereof are prepared, and the inner layer 2 is press-inserted into the tube 8.

In this manner, the inner layer 2 is electrically connected to and mechanically fixed to the tube 8. Thus, the developing roller 1 is produced with the outer layer 4 of the tube 8 provided around the inner layer 2.

The tube 8 has a wall thickness T of not less than 100 μm and not greater than 400 μm, and an interference represented by a difference $D_1$-$D_2$ between the outer diameter $D_1$ of the inner layer 2 and the inner diameter $D_2$ of the tube 8 is not less than 100 μm and not greater than 400 μm.

The wall thickness T of the tube 8 is limited to not less than 100 μm and not greater than 400 μm for the following reason.

If the wall thickness T of the tube 8 is less than the aforementioned range, the outer layer 4 is liable to have a poorer barrier property. Therefore, the paraffin oil contained in the inner layer 2 is liable to bleed on the outer peripheral surface 7 of the developing roller 1 to contaminate the photoreceptor body. Further, the outer layer 4 is liable to be worn or lost in a shorter period of time.

If the wall thickness T of the tube 8 is greater than the aforementioned range, on the other hand, the developing roller 1 is liable to have a lower flexibility with an overall Asker-C hardness of greater than 60 degrees. This may result in the deterioration of the toner and the associated density unevenness.

Where the wall thickness T of the tube 8 falls within the aforementioned range, in contrast, it is possible to impart the outer layer 4 with a proper barrier property against the paraffin oil and a proper wear resistance and to impart the developing roller 1 with a flexibility satisfying the requirement for an overall Asker-C hardness of not greater than 60 degrees. Thus, the developing roller 1 is capable of advantageously suppressing the deterioration of the toner and the associated density unevenness.

The interference ($D_1$-$D_2$) of the outer layer 4 with respect to the inner layer 2 is limited to not less than 100 μm and not greater than 400 μm for the following reason.

If the interference is less than the aforementioned range, a tightening force to be applied to the inner layer 2 by the outer layer 4 will be insufficient, so that the outer layer 4 is liable to be displaced with respect to the inner layer 2.

If the interference is greater than the aforementioned range, on the other hand, the outer layer 4 will too strongly tighten the inner layer 2. Therefore, the outer layer 4 is liable to be broken, for example, by an abutment force of the layer forming blade during the image formation.

Where the interference falls within the aforementioned range, in contrast, the developing roller 1 is substantially free from the displacement and the breakage of the outer layer 4 during the image formation.

<Inner Layer 2>

(Ethylene Propylene Rubber)

Examples of the ethylene propylene rubber usable as a material for the inner layer 2 include ethylene propylene rubbers (EPM) which are copolymers of ethylene and propylene, and ethylene propylene diene rubbers (EPDM) which are copolymers of ethylene, propylene and a diene. Particularly, the EPDM is preferred.

Various copolymers prepared by copolymerizing ethylene, propylene and a diene are usable as the EPDM. Examples, of the diene include ethylidene norbornene (ENB) and dicyclopentadiene (DCPD).

Examples of the EPDM in which the diene is ENB include ESPRENE (registered trade name) EPDM 501A (having a Mooney viscosity $ML_{1+4}$ (100° C.) of 44, an ethylene content of 52% and a diene content of 4.0%) and 505A (having a Mooney viscosity $ML_{1+4}$ (100° C.) of 47, an ethylene content of 50% and a diene content of 9.5%) available from Sumitomo Chemical Co., Ltd. Examples of the EPDM in which the diene is DCPD include ESPRENE EPDM 301A (having a Mooney viscosity $ML_1+_4$ (100° C.) of 44, an ethylene content of 50% and a diene content of 5.0%), 301 (having a Mooney viscosity $ML_{1+4}$ (100° C.) of 55, an ethylene content of 62% and a diene content of 3.0%) and 305 (having a Mooney viscosity $ML_{1+4}$ (100° C.) of 60, an ethylene content of 60% and a diene content of 7.5%) available from Sumitomo Chemical Co., Ltd., which may be used alone or in combination.

The aforementioned EPDMs are non-oil-extension type EPDMs. In addition, oil-extension type EPDMs extended with an extensionoilarealso known. Of these oil-extension type EPDMs, an EPDM extended with a paraffin oil may be used as the EPDM plus the paraffin oil in the present invention.

The aforementioned EPDMs may be used alone or in combination.

(Additional Rubber for Rubber Component)

For further improvement of the aforementioned effects of the combinational use of the ethylene propylene rubber, the paraffin oil and the thermoplastic polyamide elastomer, the ethylene propylene rubber (which may include two or more types of ethylene propylene rubbers) is preferably used alone as the rubber component for the inner layer 2.

An additional rubber may be used in combination with the ethylene propylene rubber, as long as the aforementioned effects are not impaired.

Examples of the additional rubber include a natural rubber, an isoprene rubber, a butadiene rubber, a styrene butadiene rubber, an acrylonitrile butadiene rubber and a chloroprene rubber, which may be used alone or in combination.

The proportion of the additional rubber is preferably not greater than 20 parts by mass, particularly preferably not greater than 10 parts by mass, based on 100 parts by mass of the overall rubber component.

(Paraffin Oil)

Various paraffin oils highly compatible with the ethylene propylene rubber are usable as the paraffin oil.

Examples of the paraffin oil include DIANA (registered trade name) PROCESS OIL PW series oils available from Idemitsu kosan Co., Ltd., which may be used alone or in combination.

The proportion of the paraffin oil is preferably not less than 20 parts by mass and not greater than 100 parts by mass based on 100 parts by mass of the overall rubber component including at least the ethylene propylene rubber.

If the proportion of the paraffin oil is less than the aforementioned range, it will be impossible to sufficiently provide the aforementioned effects of the blending of the paraffin oil for reducing the melt viscosity of the semiconductive rubber composition to improve the foamability and for increasing the expansion ratio of the foam to improve the flexibility of the inner layer 2 and the developing roller 1. That is, it will be impossible to impart the developing roller 1 with a higher flexibility satisfying the requirement for an overall Asker-C hardness of not greater than 60 degrees.

If the proportion of the paraffin oil is greater than the aforementioned range, on the other hand, an excess amount of the paraffin oil will bleed in an interface between the outer layer 4 and the inner layer 2 to inhibit the electrical conduction between the outer layer 4 and the inner layer 2, thereby reducing the semiconductivity of the developing roller 1. Further, the outer layer 4 is liable to be displaced with respect to the inner layer 2.

Where the proportion of the paraffin oil falls within the aforementioned range, in contrast, it is possible to impart the developing roller 1 with a flexibility satisfying the requirement for an overall Asker-C hardness of not greater than 60 degrees by improving the foamability of the semiconductive rubber composition and increasing the expansion ratio to improve the flexibility of the inner layer 2, while suppressing the reduction in the semiconductivity of the developing roller 1 and the displacement of the outer layer 4.

For further improvement of these effects, the proportion of the paraffin oil is preferably not less than 40 parts by mass and not greater than 60 parts by mass based on 100 parts by mass of the overall rubber component within the aforementioned range.

Where the oil-extension type EPDM containing the paraffin oil as the extension oil is used as the EPDM, as described above, the oil-extension type EPDM to be used may contain the extension oil in a proportion falling within the aforementioned range based on 100 parts by mass of the EPDM.

If the amount of the extension oil is insufficient, the paraffin oil may be added to the semiconductive rubber composition. If the amount of the extension oil is excessive, the non-oil-extension type EPDM or the like may be added to the semiconductive rubber composition.

The semiconductive rubber composition for the inner layer 2 is prepared by blending predetermined proportions of the rubber component containing at least the ethylene propylene rubber, the paraffin oil, a crosslinking component for crosslinking the rubber component, a foaming component for foaming the rubber composition to impart the inner layer 2 with a porous structure, and an electrically conductive agent for imparting the inner layer 2 with semiconductivity.

<Crosslinking Component>

The crosslinking component includes a crosslinking agent and an accelerating agent.

Examples of the crosslinking agent include a sulfur crosslinking agent, a thiourea crosslinking agent, a triazine derivative crosslinking agent, a peroxide crosslinking agent and monomers, which may be used alone or in combination Examples of the sulfur crosslinking agent include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine.

Examples of the thiourea crosslinking agent include tetramethylthiourea, trimethylthiourea, ethylene thiourea and thioureas represented by $(C_nH_{2n+1}NH)_2C{=}S$ (wherein n is a number of 1 to 10). These thiourea crosslinking agents may be used alone or in combination.

Examples of the peroxide crosslinking agent include benzoyl peroxide and the like.

Where the ethylene propylene rubber is the EPDM, the sulfur is preferred as the crosslinking agent.

The proportion of the sulfur to be blended is preferably not less than 0.5 parts by mass and not greater than 3 parts by mass based on 100 parts by mass of the overall rubber component containing at least the ethylene propylene rubber.

Where the oil-treated sulfur powder or the dispersive sulfur is used, for example, the proportion of the sulfur is the effective proportion of sulfur contained in the oil-treated sulfur powder or the dispersive sulfur.

Examples of the accelerating agent include inorganic accelerating agents such as lime, magnesia (MgO) and litharge (PbO), and organic accelerating agents, which may be used alone or in combination.

Examples of the organic accelerating agents include: guanidine accelerating agents such as 1,3-di-o-tolylguanidine, 1,3-diphenylguanidine, 1-o-tolylbiguanide and a di-o-tolylguanidine salt of dicatechol borate; thiazole accelerating agents such as 2-mercaptobenzothiazole and di-2-benzothiazolyl disulfide; sulfenamide accelerating agents such as N-cyclohexyl-2-benzothiazylsulfenamide; thiuram accelerating agents such as tetramethylthiuram monosulfide, tetramethylthiuram disulfide, tetraethylthiuram disulfide and dipentamethylenethiuram tetrasulfide; and thiourea accelerating agents, which may be used alone or in combination.

Different types of accelerating agents have different functions and, therefore, are preferably used in combination.

The proportion of each of the accelerating agents to be blended may be properly determined depending on the type of the accelerating agent, but is preferably not less than 0.5 parts by mass and not greater than 3 parts by mass based on 100 parts by mass of the overall rubber component.

(Foaming Component)

Various foaming agents which are thermally decomposed to generate gas are usable as the foaming component.

Examples of the foaming agents include azodicarbonamide (ADCA), 4,4'-oxybis(benzenesulfonylhydrazide) (OBSH) and N,N-dinitrosopentamethylenetetramine (DPT), which may be used alone or in combination.

The proportion of the foaming agent is preferably not less than 3 parts by mass and not greater than 8 parts by mass based on 100 parts by mass of the overall rubber component.

If the proportion of the foaming agent is less than the aforementioned range, the expansion ratio of the inner layer 2 will be insufficient. Therefore, the developing roller 1 is liable to have a lower flexibility with an overall Asker-C hardness of greater than 60 degrees. This may result in the deterioration of the toner and the associated density unevenness.

If the proportion of the foaming agent is greater than the aforementioned range, on the other hand, the expansion ratio of the inner layer 2 will be excessively high. Therefore, the developing roller 1 is liable to have an overall Asker-C hardness of less than 30 degrees. This may result in the displacement of the outer layer with respect to the inner layer, for example, during the image formation.

Where the foaming agent is the ADCA, a urea foaming assisting agent which reduces the decomposition temperature of the ADCA to promote the decomposition of the ADCA, for example, may be used in combination with the ADCA.

The proportion of the foaming assisting agent to be blended is properly determined depending on the type of the foaming agent to be used in combination with the foaming assisting agent, but is preferably not less than 1 part by mass and not greater than 3 parts by mass based on 100 parts by mass of the overall rubber component.

(Electrically Conductive Agent)

An electron conductive agent and/or an ion conductive agent may be used as the electrically conductive agent as described above. Particularly, the electron conductive agent is preferred.

Examples of the electron conductive agent include various electron conductive carbon blacks and graphites, which may be used alone or in combination.

The proportion of the electron conductive agent to be blended is preferably not less than 30 parts by mass and not greater than 60 parts by mass based on 100 parts by mass of the overall rubber component.

If the proportion of the electron conductive agent is less than the aforementioned range, the inner layer 2 is liable to have an excessively high resistance, making it impossible to impart the entire developing roller 1 with satisfactory semiconductivity. This may result in reduction in solid black image density, for example.

If the proportion of the electron conductive agent is greater than the aforementioned range, on the other hand, even the paraffin-containing inner layer 2 is liable to have a higher hardness. Hence, the developing roller 1 is liable to have a higher hardness, i.e., an overall Asker-C hardness of greater than 60 degrees, and a lower flexibility. This may result in the deterioration of the toner and the associated density unevenness.

(Other Additives)

As required, the semiconductive rubber composition may further contain various additives. Examples of the additives include a crosslinking assisting agent, a degradation preventing agent, a filler, an anti-scorching agent, a lubricant, a pigment, an anti-static agent, a flame retarder, a neutralizing agent, a nucleating agent and a co-crosslinking agent.

Examples of the crosslinking assisting agent include metal compounds such as zinc oxide, fatty acids such as stearic acid, oleic acid and cotton seed fatty acids, and other conventionally known crosslinking assisting agents, which may be used alone or in combination.

The proportion of the crosslinking assisting agent to be blended is preferably not less than 0.5 parts by mass and not greater than 6 parts by mass based on 100 parts by mass of the overall rubber component.

Examples of the degradation preventing agent include various anti-aging agents and anti-oxidants.

Examples of the anti-aging agents include nickel diethyldithiocarbamate (NOCRAC (registered trade name) NEC-P available from Ouchi Shinko Chemical Industrial Co., Ltd.) and nickel dibutyldithiocarbamate (NOCRAC NBC available from Ouchi Shinko Chemical Industrial Co., Ltd.)

The proportion of the degradation preventing agent such as the anti-aging agent to be blended is preferably not less than 0.3 parts by mass and not greater than 1 part by mass based on 100 parts by mass of the overall rubber component.

Examples of the filler include zinc oxide, silica, reinforcement carbon black, clay, talc, calcium carbonate, magnesium carbonate and aluminum hydroxide, which may be used alone or in combination.

The blending of the filler improves the mechanical strength and the like of the inner layer 2.

The proportion of the filler to be blended is preferably not less than 20 parts by mass and not greater than 40 parts by mass based on 100 parts by mass of the overall rubber component.

Examples of the anti-scorching agent include N-cyclohexylthiophthalimide, phthalic anhydride, N-nitrosodiphenylamine and 2,4-diphenyl-4-methyl-1-pentene, which may be used alone or in combination. Particularly, N-cyclohexylthiophthalimide is preferred.

The proportion of the anti-scorching agent to be blended is preferably not less than 0.1 part by mass and not greater than 5 parts by mass based on 100 parts by mass of the overall rubber component.

The co-crosslinking agent serves to crosslink itself as well as the rubber component to increase the overall molecular weight.

Examples of the co-crosslinking agent include ethylenically unsaturated monomers typified by methacrylic esters, metal salts of methacrylic acid and acrylic acid, polyfunctional polymers utilizing functional groups of 1,2-polybutadienes, and dioximes, which may be used alone or in combination.

Examples of the ethylenically unsaturated monomers include:

(a) monocarboxylic acids such as acrylic acid, methacrylic acid and crotonic acid;
(b) dicarboxylic acids such as maleic acid, fumaric acid and itaconic acid;
(c) esters and anhydrides of the unsaturated carboxylic acids (a) and (b);
(d) metal salts of the monomers (a) to (c);
(e) aliphatic conjugated dienes such as 1,3-butadiene, isoprene and 2-chloro-1,3-butadiene;
(f) aromatic vinyl compounds such as styrene, α-methylstyrene, vinyltoluene, ethylvinylbenzene and divinylbenzene;
(g) vinyl compounds such as triallyl isocyanurate, triallyl cyanurate and vinylpyridine each having a hetero ring; and
(h) cyanovinyl compounds such as (meth)acrylonitrile and α-chloroacrylonitrile, acrolein, formyl sterol, vinyl methyl ketone, vinyl ethyl ketone and vinyl butyl ketone.

These ethylenically unsaturated monomers may be used alone or in combination.

Monocarboxylic acid esters are preferred as the esters (c) of the unsaturated carboxylic acids.

Specific examples of the monocarboxylic acid esters include:

alkyl (meth) acrylates such as methyl (meth)acrylate, ethyl (meth)acrylate, n-propyl (meth)acrylate, i-propyl (meth)acrylate, n-butyl (meth)acrylate, i-butyl (meth)acrylate, n-pentyl (meth)acrylate, i-pentyl (meth)acrylate, n-hexyl (meth)acrylate, cyclohexyl (meth)acrylate, 2-ethylhexyl (meth)acrylate, octyl (meth)acrylate, i-nonyl (meth) acrylate, tert-butylcyclohexyl (meth)acrylate,decyl(meth) acrylate, dodecyl (meth)acrylate, hydroxymethyl (meth) acrylate and hydroxyethyl (meth)acrylate;

aminoalkyl (meth)acrylates such as aminoethyl (meth) acrylate, dimethylaminoethyl (meth)acrylate and butylaminoethyl (meth)acrylate;

(meth)acrylates such as benzyl (meth)acrylate, benzoyl (meth)acrylate and aryl (meth)acrylates each having an aromatic ring;

(meth)acrylates such as glycidyl (meth)acrylate, methaglycidyl (meth)acrylate and epoxycyclohexyl (meth)acrylate each having an epoxy group;

(meth)acrylates such as N-methylol (meth)acrylamide, γ-(meth)acryloxypropyltrimethoxysilane and tetrahydrofurfuryl methacrylate each having a functional group; and polyfunctional (meth)acrylates such as ethylene glycol di(meth)acrylate, trimethylolpropane tri(meth)acrylate, ethylene dimethacrylate (EDMA), polyethylene glycol dimethacrylate and isobutylene ethylene dimethacrylate. These monocarboxylic acid esters may be used alone or in combination.

(Semiconductive Rubber Composition)

The semiconductive rubber composition containing the ingredients described above can be prepared in a conventional manner.

First, the rubber component is simply kneaded. After the paraffin oil, the electrically conductive agent and the additives other than the crosslinking component and the foaming component are added to and kneaded with the rubber component, the crosslinking component and the foaming component are finally added to and kneaded with the resulting mixture. Thus, the semiconductive rubber composition is prepared.

A sealed kneading machine such as an Intermix mixer, a Banbury mixer, a kneader or an extruder, an open roll or the like, for example, is usable for the kneading.

(Formation of Inner Layer 2)

For the formation of the inner layer 2, the semiconductive rubber composition described above is extruded into a tubular body by means of an extruder, and the tubular body is cut to a predetermined length. Then, the resulting tubular body is foamed and crosslinked by pressure and heat.

In turn, the foamed and crosslinked tubular body is heated in an oven to be thereby secondarily crosslinked, then cooled, and polished to a predetermined outer diameter $D_1$.

<Shaft 6>

The shaft 6 is a unitary member made of a metal such as iron, aluminum, an aluminum alloy or a stainless steel.

The shaft 6 may be inserted through and fixed to the through-hole 5 at any time between the end of the cutting of the tubular body and the end of the press-insertion of the inner layer 2 in the tube 8.

However, it is preferred that, with the shaft 6 inserted through and fixed to the through-hole 5 after the cutting, the tubular body is secondarily crosslinked and polished, and the resulting inner layer 2 is press-inserted into the tube 8 as shown in FIG. 2A.

Thus, the warpage and the deformation of the inner layer 2 can be prevented which may otherwise occur due to the expansion and the contraction of the tubular body during the secondary crosslinking.

Further, the tubular body may be polished while being rotated about the shaft 6. This improves the working efficiency in the polishing, and suppresses the deflection of the outer peripheral surface 3. Further, the inner layer 2 can be press-inserted into the tube 8 with an improved working efficiency.

The shaft 6 is electrically connected to and mechanically fixed to the inner layer 2 via an electrically conductive thermosetting adhesive agent. Alternatively, a shaft having an outer diameter that is greater than the inner diameter of the through-hole 5 is used as the shaft 6, and press-inserted into the through-hole 5 to be electrically connected to and mechanically fixed to the inner layer 2. Thus, the shaft 6 and the inner layer 2 are unitarily rotatable.

In the former case, the thermosetting adhesive agent is cured when the tubular body is secondarily cross linked by the heating in the oven. Thus, the shaft 6 is electrically connected to and mechanically fixed to the inner layer 2.

In the latter case, the electrical connection and the mechanical fixing are achieved simultaneously with the press insertion.

<Outer Layer 4>

The outer layer 4 is formed of the seamless tube 8 of the semiconductive thermoplastic polyamide elastomer as described above.

The tube 8 is formed by extruding an elastomer composition containing the thermoplastic polyamide elastomer into a tubular body having a predetermined wall thickness T and a predetermined inner diameter $D_2$.

Examples of the thermoplastic polyamide elastomer include block copolymers containing a hard segment of a polyamide, and a soft segment of at least one of a polyether, a polyester, a polypropylene glycol and a polytetramethylene ether glycol. These block copolymers may be used alone or in combination.

In order to impart the tube 8 with semiconductivity, an electron conductive agent and/or an ion conductive agent may be blended in the elastomer composition for the tube 8. Particularly, the electron conductive agent is preferred for prevention of the contamination of the photoreceptor body, the toner and peripheral components which may otherwise occur due to bleeding.

Examples of the electron conductive agent include the electron conductive carbon blacks and graphites described above, and carbon fibrils such as carbon nanotubes, which may be used alone or in combination.

In consideration of the costs and the characteristic properties of the developing roller, a carbon black having a greater DBP oil absorption amount is preferred because even addition of a small amount of the carbon black makes it possible to form an electrically conductive circuit and to control the resistance.

The proportion of the carbon black to be blended is preferably not greater than 30 parts by mass, particularly preferably not greater than 15 parts by mass, based on 100 parts by mass of the thermoplastic polyamide elastomer.

If the proportion of the carbon black is greater than the aforementioned range, the outer layer 4 is liable to have a higher hardness to degrade the toner, and the costs will be increased.

The proportion of the carbon black does not have a particular lower limit, but is preferably not less than 0.5 parts by mass, particularly preferably not less than 1 part by mass, based on 100 parts by mass of the thermoplastic polyamide elastomer in order to impart the tube 8 with proper semiconductivity.

The developing roller 1 including the aforementioned parts is usable in various electrophotographic image forming apparatuses such as a laser printer, an electrostatic copying machine, a plain paper facsimile machine and a printer-copier-facsimile multifunction machine.

EXAMPLES

Example 1

Of ethylene propylene rubbers, an EPDM (ESPRENE EPDM 505A available from Sumitomo Chemical Co., Ltd. and having a Mooney viscosity $ML_{1+4}$ (100° C.) of 47, an ethylene content of 50% and a diene content of 9.5%) was used as a rubber component.

DIANA PROCESS OIL PW-380 available from Idemitsu kosan Co., Ltd. was used as a paraffin oil.

While 100 parts by mass of the EPDM was simply kneaded by means of a Banbury mixer, 60 parts by mass of the paraffin oil and ingredients other than a crosslinking component and a foaming component shown below in Table 1 were added to and kneaded with the EPDM, and then the crosslinking component and the foaming component were added to and further kneaded with the resulting mixture. Thus, a semiconductive rubber composition for an inner layer was prepared.

TABLE 1

| Ingredients | Parts by mass |
|---|---|
| Filler | 30 |
| Crosslinking assisting agent (I) | 5 |
| Crosslinking assisting agent (II) | 1 |
| Electron conductive agent | 50 |
| Foaming agent | 6 |
| Foaming assisting agent | 2 |
| Crosslinking agent | 1.6 |
| Accelerating agent TS | 1 |
| Accelerating agent MBTS | 2 |

The ingredients shown in Table 1 are as follows. The amounts (parts by mass) shown in Table 1 are based on 100 parts by mass of the EPDM as the rubber component.

Filler: Heavy calcium carbonate BF-300 available from Shiraishi Calcium Kaisha, Ltd.

Crosslinking assisting agent (I): Zinc oxide type-2 available from Mitsui Mining & Smelting Co., Ltd.

Crosslinking assisting agent (II): Stearic acid TSUBAKI (trade name) available from NOF Corporation Electron conductive agent: Carbon black ISAF SEAST 6 available from Tokai Carbon Co., Ltd.

Foaming agent: ADCA VINYFOR AC#3 available from Eiwa Chemical Industry Co., Ltd.

Foaming assisting agent: Urea foaming assisting agent CELLPASTE 101 available from Eiwa Chemical Industry Co., Ltd.

Crosslinking agent: 5% oil-containing sulfur available from Tsurumi Chemical Industry Co., Ltd.

Accelerating agent TS: Tetramethylthiuram monosulfide, thiuram accelerating agent SANCELER (registered trade name) TS available from Sanshin Chemical Industry Co., Ltd.

Accelerating agent MBTS: Di-2-benzothiazolyl disulfide, thiazole accelerating agent SANCELER DM available from Sanshin Chemical Industry Co., Ltd.

The semiconductive rubber composition was fed into an extruder, and extruded into a tubular body having an outer diameter of 15 mm and an inner diameter of 6.5 mm. Then, the tubular body was fitted around a temporary crosslinking shaft, and crosslinked and foamed in a vulcanization can at 160° C. for 1 hour.

Then, the crosslinked tubular body was removed from the temporary shaft, then fitted around a shaft having an outer diameter of 7.0 mm and an outer peripheral surface to which an electrically conductive thermosetting adhesive agent was applied, and heated in an oven at 160° C. Thus, the tubular body was bonded to the shaft. Thereafter, the outer peripheral surface of the resulting tubular body was polished to an outer diameter $D_1$ of 16.00 mm by means of a cylindrical polishing machine, and washed with water. Thus, an inner layer unified with the shaft was produced.

A seamless semiconductive thermoplastic polyamide elastomer tube (electrically conductive nylon sleeve SLV available from Gunze Limited) having a wall thickness T of 100 μm and an inner diameter $D_2$ of 15.80 mm was prepared for an outer layer. An interference represented by a difference $D_1$-$D_2$ between the outer diameter $D_1$ and the inner diameter $D_2$ was 200 μm.

After the inner layer was press-inserted into the tube, opposite ends of the resulting product were cut, and the outer peripheral surface of the tube was mirror-polished with a #2000 lapping film (MIRROR FILM (registered trade name) available from Sankyo-Rikagaku Co., Ltd.) to be roughened. Thus, a developing roller was produced.

The developing roller had an overall Asker-C hardness of 32 degrees as measured with a load of 1 kg by the aforementioned measuring method.

The outer peripheral surface of the developing roller had a profile curve arithmetic average roughness Ra of 1 μm as determined in the aforementioned manner based on the results of measurement obtained with the use of a laser microscope (VX-100 available from Keyence Corporation).

Example 2

A developing roller was produced in substantially the same manner as in Example 1, except that the proportion of the ADCA blended as the foaming agent in the semiconductive rubber composition was 5 parts by mass.

The tube for the outer layer had a wall thickness T of 100 μm, and an interference represented by a difference $D_1$-$D_2$ between the outer diameter $D_1$ and the inner diameter $D_2$ was 200 μm.

The developing roller had an overall Asker-C hardness of 45 degrees. The outer peripheral surface of the developing roller had a profile curve arithmetic average roughness Ra of 1 μm.

Example 3

A developing roller was produced in substantially the same manner as in Example 1, except that the outer diameter $D_1$ of the inner layer was 15.80 mm, and a seamless semiconductive thermoplastic polyamide elastomer tube SLV (available from Gunze Limited) having an inner diameter $D_2$ of 15.60 mm and a wall thickness T of 200 μm was used for the outer layer.

As described above, the wall thickness T of the tube for the outer layer was 200 μm, and an interference represented by a difference $D_1$-$D_2$ between the outer diameter $D_1$ and the inner diameter $D_2$ was 200 μm.

The developing roller had an overall Asker-C hardness of 47 degrees. The outer peripheral surface of the developing roller had a profile curve arithmetic average roughness Ra of 1 μm.

Example 4

A developing roller was produced in substantially the same manner as in Example 1, except that the outer diameter $D_1$ of the inner layer was 15.40 mm, and a seamless semiconductive thermoplastic polyamide elastomer tube SLV (available from Gunze Limited) having an inner diameter $D_2$ of 15.20 mm and a wall thickness T of 400 μm was used for the outer layer.

As described above, the wall thickness T of the tube for the outer layer was 400 μm, and an interference represented by a difference $D_1$-$D_2$ between the outer diameter $D_1$ and the inner diameter $D_2$ was 200 μm.

The developing roller had an overall Asker-C hardness of 55 degrees. The outer peripheral surface of the developing roller had a profile curve arithmetic average roughness Ra of 1 μm.

Example 5

A developing roller was produced in substantially the same manner as in Example 3, except that the proportion of the paraffin oil blended in the semiconductive rubber composition was 40 parts by mass and the proportion of the ADCA as the foaming agent was 4 parts by mass.

The wall thickness T of the tube for the outer layer was 200 μm, and an interference represented by a difference $D_1$-$D_2$ between the outer diameter $D_1$ and the inner diameter $D_2$ was 200 μm.

The developing roller had an overall Asker-C hardness of 58 degrees. The outer peripheral surface of the developing roller had a profile curve arithmetic average roughness Ra of 1 μm.

Example 6

A developing roller was produced in substantially the same manner as in Example 3, except that the proportion of the paraffin oil blended in the semiconductive rubber composition was 40 parts by mass, the proportion of the ADCA as the foaming agent was 5 parts by mass, and the outer diameter $D_1$ of the inner layer was 15.70 mm.

The wall thickness T of the tube for the outer layer was 200 μm, and an interference represented by a difference $D_1$-$D_2$ between the outer diameter $D_1$ and the inner diameter $D_2$ was 100 μm.

The developing roller had an overall Asker-C hardness of 45 degrees. The outer peripheral surface of the developing roller had a profile curve arithmetic average roughness Ra of 1 μm.

Example 7

A developing roller was produced in substantially the same manner as in Example 3, except that the proportion of the paraffin oil blended in the semiconductive rubber composition was 40 parts by mass, the proportion of the ADCA as the foaming agent was 5 parts by mass, and the outer diameter $D_1$ of the inner layer was 16.00 mm.

The wall thickness T of the tube for the outer layer was 200 μm, and an interference represented by a difference $D_1$–$D_2$ between the outer diameter $D_1$ and the inner diameter $D_2$ was 400 μm.

The developing roller had an overall Asker-C hardness of 48 degrees. The outer peripheral surface of the developing roller had a profile curve arithmetic average roughness Ra of 1 μm.

Example 8

A developing roller was produced in substantially the same manner as in Example 3, except that the proportion of the paraffin oil blended in the semiconductive rubber composition was 40 parts by mass and the proportion of the ADCA as the foaming agent was 5 parts by mass.

The wall thickness T of the tube for the outer layer was 200 μm, and an interference represented by a difference $D_1$-$D_2$ between the outer diameter $D_1$ and the inner diameter $D_2$ was 200 μm.

The developing roller had an overall Asker-C hardness of 45 degrees. The outer peripheral surface of the developing roller had a profile curve arithmetic average roughness Ra of 1 μm.

Example 9

A developing roller was produced in substantially the same manner as in Example 8, except that the outer peripheral surface of the developing roller was mirror-polished under different conditions so as to have a profile curve arithmetic average roughness Ra of 1.48 μm.

The wall thickness T of the tube for the outer layer was 200 μm, and an interference represented by a difference $D_1$-$D_2$ between the outer diameter $D_1$ and the inner diameter $D_2$ was 200 μm.

The developing roller had an overall Asker-C hardness of 45 degrees. The outer peripheral surface of the developing roller had a profile curve arithmetic average roughness Ra of 1.48 μm as described above.

Comparative Example 1

A non-expansible semiconductive rubber composition was prepared in substantially the same manner as in Example 1, except that the proportion of the paraffin oil blended in the semiconductive rubber composition was 50 parts by mass, and neither the foaming agent nor the foaming assisting agent were blended.

By using the semiconductive rubber composition thus prepared, a non-porous single-layer developing roller having an outer diameter $D_1$ of 16.00 mm was produced in substantially the same manner as in Example 1, except that the outer layer was not formed. The outer peripheral surface of the developing roller was mirror-polished so as to have a profile curve arithmetic average roughness Ra of 1 μm.

The developing roller had an overall Asker-C hardness of 50 degrees. The outer peripheral surface of the developing roller had a profile curve arithmetic average roughness Ra of 1 μm as described above.

Comparative Example 2

A developing roller was produced in substantially the same manner as in Example 4, except that the proportion of the paraffin oil blended in the semiconductive rubber composition was 50 parts by mass and the proportion of the ADCA as the foaming agent was 2 parts by mass.

The wall thickness T of the tube for the outer layer was 400 μm, and an interference represented by a difference $D_1$-$D_2$ between the outer diameter $D_1$ and the inner diameter $D_2$ was 200 μm.

The developing roller had an overall Asker-C hardness of 65 degrees. The outer peripheral surface of the developing roller had a profile curve arithmetic average roughness Ra of 1 μm.

Comparative Example 3

A developing roller was produced in substantially the same manner as in Example 1, except that the proportion of the paraffin oil blended in the semiconductive rubber composition was 50 parts by mass and the proportion of the ADCA as the foaming agent was 8 parts by mass.

The wall thickness T of the tube for the outer layer was 100 μm, and an interference represented by a difference $D_1$-$D_2$ between the outer diameter $D_1$ and the inner diameter $D_2$ was 200 μm.

The developing roller had an overall Asker-C hardness of 25 degrees. The outer peripheral surface of the developing roller had a profile curve arithmetic average roughness Ra of 1 μm.

Comparative Example 4

A developing roller was produced in substantially the same manner as in Example 3, except that the proportion of the paraffin oil blended in the semiconductive rubber composition was 50 parts by mass, the proportion of the ADCA as the foaming agent was 6 parts by mass, and the outer diameter $D_1$ of the inner layer was 16.10 mm.

The wall thickness T of the tube for the outer layer was 200 μm, and an interference represented by a difference $D_1$-$D_2$ between the outer diameter $D_1$ and the inner diameter $D_2$ was 500 μm.

The developing roller had an overall Asker-C hardness of 55 degrees. The outer peripheral surface of the developing roller had a profile curve arithmetic average roughness Ra of 1 μm.

Comparative Example 5

A developing roller was produced in substantially the same manner as in Example 3, except that the proportion of the paraffin oil blended in the semiconductive rubber composition was 40 parts by mass, the proportion of the ADCA as the foaming agent was 4 parts by mass, and the outer diameter $D_1$ of the inner layer was 15.66 mm.

The wall thickness T of the tube for the outer layer was 200 μm, and an interference represented by a difference $D_1$-$D_2$ between the outer diameter $D_1$ and the inner diameter $D_2$ was 60 μm.

The developing roller had an overall Asker-C hardness of 58 degrees. The outer peripheral surface of the developing roller had a profile curve arithmetic average roughness Ra of 1 μm.

Comparative Example 6

A developing roller was produced in substantially the same manner as in Example 1, except that the proportion of the paraffin oil blended in the semiconductive rubber composition was 40 parts by mass, the proportion of the ADCA as the foaming agent was 6 parts by mass, the outer diameter $D_1$ of the inner layer was 15.10 mm, and a seamless semiconductive thermoplastic polyamide elastomer tube SLV (available from Gunze Limited) having an inner diameter $D_2$ of 15.00 mm and a wall thickness T of 500 μm was used for the outer layer.

As described above, the wall thickness T of the tube for the outer layer was 500 μm, and an interference represented by a difference $D_1$-$D_2$ between the outer diameter $D_1$ and the inner diameter $D_2$ was 100 μm.

The developing roller had an overall Asker-C hardness of 62 degrees. The outer peripheral surface of the developing roller had a profile curve arithmetic average roughness Ra of 1 μm.

<Actual Machine Test>

A toner cartridge including a developing roller for a commercially available laser printer was prepared, and the developing rollers produced in Examples and Comparative Examples were each incorporated in the cartridge instead of the original developing roller. With the use of the resulting toner cartridge, images were sequentially formed at a density of 1% on 3000 A4-size plain paper sheets at a temperature of 23±1° C. at a relative humidity of 55±1%. Thereafter, the state of the developing roller was observed, and the formed images were checked for white streaks and dot-form density unevenness.

The developing roller was evaluated against the density unevenness based on the following criteria.

Excellent (○): No density unevenness was observed in the formed images.

Practically acceptable (Δ): Slight density unevenness was observed in the formed images.

Unacceptable (x): Density unevenness was observed in the formed images.

The above results are shown in Tables 2 to 4.

TABLE 2

| | Example 1 | Example 2 | Example 3 | Example 4 | Example 5 |
|---|---|---|---|---|---|
| | Parts by mass | | | | |
| Paraffin oil | 60 | 60 | 60 | 60 | 40 |
| Foaming agent | 6 | 5 | 6 | 6 | 4 |
| Foaming assisting agent | 2 | 2 | 2 | 2 | 2 |
| Outer diameter $D_1$ (mm) of inner layer | 16.00 | 16.00 | 15.80 | 15.40 | 15.80 |
| Inner diameter $D_2$ (mm) of outer layer | 15.80 | 15.80 | 15.60 | 15.20 | 15.60 |
| Wall thickness T (μm) of tube | 100 | 100 | 200 | 400 | 200 |
| Interference $D_1$-$D_2$ (μm) | 200 | 200 | 200 | 200 | 200 |
| Asker-C hardness (degrees) | 32 | 45 | 47 | 55 | 58 |
| Arithmetic average roughness Ra (μm) | 1 | 1 | 1 | 1 | 1 |
| State of developing roller | Normal | Normal | Normal | Normal | Normal |
| Density unevenness | Δ | ○ | ○ | Δ | Δ |

TABLE 3

| | Example 6 | Example 7 | Example 8 | Example 9 | Comparative Example 1 |
|---|---|---|---|---|---|
| | Parts by mass | | | | |
| Paraffin oil | 40 | 40 | 40 | 40 | 50 |
| Foaming agent | 5 | 5 | 5 | 5 | — |
| Foaming assisting agent | 2 | 2 | 2 | 2 | — |
| Outer diameter $D_1$ (mm) of inner layer | 15.70 | 16.00 | 15.80 | 15.80 | 16.00 |
| Inner diameter $D_2$ (mm) of outer layer | 15.60 | 15.60 | 15.60 | 15.60 | — |
| Wall thickness T (μm) of tube | 200 | 200 | 200 | 200 | — |
| Interference $D_1$-$D_2$ (μm) | 100 | 400 | 200 | 200 | — |
| Asker-C hardness (degrees) | 45 | 48 | 45 | 45 | 50 |
| Arithmetic average roughness Ra (μm) | 1 | 1 | 1 | 1.48 | 1 |
| State of developing roller | Normal | Normal | Normal | Normal | Normal |
| Density unevenness | ○ | ○ | ○ | ○ | x |

TABLE 4

| | Comparative Example 2 | Comparative Example 3 | Comparative Example 4 | Comparative Example 5 | Comparative Example 6 |
|---|---|---|---|---|---|
| | Parts by mass | | | | |
| Paraffin oil | 50 | 50 | 50 | 40 | 40 |
| Foaming agent | 2 | 8 | 6 | 4 | 6 |
| Foaming assisting agent | 2 | 2 | 2 | 2 | 2 |
| Outer diameter $D_1$ (mm) of inner layer | 15.40 | 16.00 | 16.10 | 15.66 | 15.10 |
| Inner diameter $D_2$ (mm) of outer layer | 15.20 | 15.80 | 15.60 | 15.60 | 15.00 |
| Wall thickness T (μm) of tube | 400 | 100 | 200 | 200 | 500 |
| Interference $D_1$-$D_2$ (μm) | 200 | 200 | 500 | 60 | 100 |
| Asker-C hardness (degrees) | 65 | 25 | 55 | 58 | 62 |
| Arithmetic average roughness Ra (μm) | 1 | 1 | 1 | 1 | 1 |
| State of developing roller | Normal | Outer layer displaced | Outer layer broken | Outer layer displaced | Normal |
| Density unevenness | x | — | — | — | x |

The results for Examples 1 to 9 and Comparative Example 1 shown in Tables 2 to 4 indicate that, where the developing roller has a double layer structure including a porous inner layer and an outer layer of a tube, the deterioration of the toner, the associated image density unevenness and the like are less liable to occur.

The results for Examples 1 to 9 and Comparative Examples 2, 3 and 6 indicate that the developing roller of the double layer structure is required to have an overall Asker-C hardness of not less than 30 degrees and not greater than 60 degrees in order to provide the aforementioned effects without the displacement of the outer layer.

The results for Examples 1 to 9 and Comparative Examples 4 to 6 indicate that the tube for the outer layer is required to have a wall thickness T of not less than 100 μm and not greater than 400 μm and the interference represented by the difference $D_1$-$D_2$ between the outer diameter $D_1$ of the inner layer and the inner diameter $D_2$ of the tube is required to be not less than 100 μm and not greater than 400 μm for production of a developing roller free from the breakage and the displacement of the outer layer and excellent in the aforementioned effects.

The results for Examples 1 to 9 indicate that the overall Asker-C hardness is preferably not less than 45 degrees and not greater than 50 degrees for further improvement of the aforementioned effects and hence the proportion of the paraffin oil is preferably not less than 20 parts by mass and not greater than 100 parts by mass, particularly preferably not less than 40 parts by mass and not greater than 60 parts by mass, based on 100 parts by mass of the overall rubber component, and that the outer peripheral surface preferably has a profile curve arithmetic average roughness Ra of not greater than 1.5 μm.

This application corresponds to Japanese Patent Application No. 2015-248614 filed in the Japan Patent Office on Dec. 21, 2015, the disclosure of which is incorporated herein by reference in its entirety.

What is claimed is:

1. A developing roller comprising:

a tubular porous inner layer of a foamed product of a semiconductive rubber composition comprising an ethylene propylene rubber and a paraffin oil; and a single outermost layer comprising a seamless tube of a semiconductive thermoplastic polyamide elastomer provided on an outer periphery of the inner layer;

the developing roller having an overall Asker-C hardness of not less than 30 degrees and not greater than 60 degrees, wherein the seamless tube has a wall thickness T of not less than 100 μm and not greater than 400 μm, and an interference represented by a difference $D_1$–$D_2$ between the outer diameter $D_1$ of the inner layer and the inner diameter $D_2$ of the seamless tube is not less than 100 μm and not greater than 400 μm.

2. The developing roller according to claim 1, wherein the paraffin oil is present in a proportion of not less than 20 parts by mass and not greater than 100 parts by mass based on 100 parts by mass of an overall rubber component including at least the ethylene propylene rubber in the semiconductive rubber composition.

3. The developing roller according to claim 2, wherein the seamless tube has an outer peripheral surface roughened to a profile curve arithmetic average roughness Ra of not greater than 1.5 μm.

4. The developing roller according to claim 1, wherein the seamless tube has an outer peripheral surface roughened to a profile curve arithmetic average roughness Ra of not greater than 1.5 μm.

* * * * *